US006855038B2

(12) United States Patent
Caporusso

(10) Patent No.: US 6,855,038 B2
(45) Date of Patent: Feb. 15, 2005

(54) SHAPING PULLEY ASSEMBLY FOR BELT NOTCHING MACHINE

(75) Inventor: Alessandro Caporusso, Piedimonte San Germano (IT)

(73) Assignee: CML International S.p.A., Piedimonte S.G. (IT)

( * ) Notice: Subject to any disclaimer, the term of this patent is extended or adjusted under 35 U.S.C. 154(b) by 0 days.

(21) Appl. No.: 10/678,218

(22) Filed: Oct. 6, 2003

(65) Prior Publication Data

US 2004/0097178 A1 May 20, 2004

(30) Foreign Application Priority Data

Oct. 4, 2002 (IT) ..... RM2002A0499

(51) Int. Cl.[7] ..... B24B 21/20
(52) U.S. Cl. ..... 451/311; 451/297
(58) Field of Search ..... 451/311, 296, 451/297

(56) References Cited

U.S. PATENT DOCUMENTS 344,835 A 7/1886 Hollister ..... 451/311
5,357,714 A 10/1994 Landhuis ..... 451/311
5,437,570 A 8/1995 Landhuis ..... 451/296

FOREIGN PATENT DOCUMENTS

DE 4131523 A1 * 4/1993 ..... B24B/21/20
DE 295 04 077 4/1995
EP 488688 A2 * 6/1992 ..... F16G/1/00
WO 03/022481 A1 3/2003 ..... B21D/41/02

* cited by examiner

*Primary Examiner*—David B. Thomas
(74) *Attorney, Agent, or Firm*—Young & Thompson

(57) ABSTRACT

A shaping pulley assembly (6) for a belt notching machine, including on a frame (1) a pair of driving and shaping pulleys (3, 4) for a grinding belt (5), includes a shaping pulley holder element (9) like a fork supported by the frame (1), having a C-shaped body with end brackets (90, 91), a stationary center and a removable counter-center, both being live centers which are housed in respective housings of the end brackets (90, 91), a shaping pulley (4) in the form of a cylindrical roller provided with center holes (42, 43) opposite to each other for fixed center and removable counter-center, respectively on the bases (40, 41) of the shaping pulley.

8 Claims, 2 Drawing Sheets

SHAPING PULLEY ASSEMBLY FOR BELT NOTCHING MACHINE

TECHNICAL FIELD

This invention relates to a shaping pulley assembly for belt notching machine. While it will be referred below only to a belt notching machine, it should be appreciated that the subject-matter of the invention can be applied in the same way to other machines operating through a grinding belt, such as buffing machines, linishers, honing machines, and polishing machines.

A notching machine is a grinding machine for shaping or recessing the ends of tubular workpieces and/or solid sections. The notching machine includes a pair of pulleys and a grinding belt passing around the pulleys: one of the pulleys is a driving pulley for the grinding belt, and the other pulley is a shaping pulley co-operating with the grinding belt to shape recesses. A device for clamping a tubular workpiece or a solid section is located near the shaping pulley and is movable towards and away from the shaping pulley. The shaping pulley, being in general of a diameter equal or close to the diameter of the tubular workpiece, is interchangeable in order to permit differently sized recesses to be performed.

BACKGROUND ART

In prior art notching machines it has been attempted to achieve that a shaping pulley is installed and removed easily and expeditiously in order to obtain, through a manual operation, a replacement of a pulley by another one with different diameter, with a result that differently sized recesses can be performed.

Among others, U.S. Pat. No. 5,357,714 granted to Landhuis on Oct. 25, 1994 discloses an apparatus for grinding recesses, wherein a shaping pulley has a through shaft with races for ball bearings. The one end of the through shaft of the shaping pulley is inserted in a hole, and the opposite end of the shaft is pushed into a fork provided with stop means, the hole and the fork being performed in side walls of the apparatus respectively. In the side walls, internally, there are pivotally put two pairs of ball bearings, respectively, which are designed to engage said races in the shaft of the shaping pulley. The arrangement of this shaping pulley on the grinding machine requires accurately machined surfaces for the coupling of the races in the shaft with the pairs of ball bearings. Further, a great number of components is required.

U.S. Pat. No. 5,437,570, also granted to Landhuis on Aug. 1, 1995 discloses an apparatus for grinding recesses, wherein a shaping pulley has a shaft section on both its sides. Each shaft section is provided with a coaxial bearing element that is designed to be received and locked into tapered housings internally formed in respective side walls of the apparatus. One should appreciate that the above mentioned disposition requires that each shaping pulley is provided with a couple of ball bearings being of an internal diameter corresponding to the diameter of the shaft sections.

Furthermore, in an apparatus for grinding recesses or notching machine with ready replacement of its shaping pulley according to the previous patent application PCT No. 01/00469 of the same inventor, a supporting device for a shaping pulley, which has shaft sections in its opposite ends, is provided with rest bushings housing a rolling bearing for receiving a respective shaft section of said shaft sections of the shaping pulley, rest bushings that are mounted on a movable assembly connected to the frame of the notching machine by means of a clamping element to the frame of the apparatus.

In the prior art notching machines the supporting device for a shaping pulley is mounted on open rolling bearings, i.e. without any protection. Therefore, these open rolling bearings, which are further subjected to the vibrations generated at high speeds as well as to the contaminating action of chips and wastes due to the wear of the grinding belt in its operation, tend to be damaged easily and to have a short life, with a consequence of rise in costs and in waste of time for an operator of the machine. As a result, each rolling bearing on the ends of the shaping pulling is affected in a particularly considerable way, with equal grinding belt and same number of revolutions per minute of the driving pulley, when the idle shaping pulley is of a very small diameter to grind corresponding recesses, the rotation speed of the shaping pulley increasing in inverse proportion with a decrease of its diameter.

An object of the present invention is to permit the location of the shaping pulley in a notching machine without any risk of blocking due to a failure of its support rolling bearings.

DISCLOSURE OF THE INVENTION

Therefore, the present invention provides a shaping pulley assembly for a belt notching machine, including on a frame a pair of pulleys carrying a grinding belt, the one of the pulleys being a driving pulley for the grinding belt, and the other one being a shaping pulley that is interchangeably mounted on the frame to co-operate with the grinding belt for forming differently sized recesses in tubular workpieces and/or solid sections, characterized in that the shaping pulley assembly comprises:

- a shaping pulley holder element like a fork supported by the frame, having a C-shaped body with end brackets, one of which is provided with a housing coaxial to another housing in the other end bracket,
- a stationary centre and a removable counter-centre, both being live centres which are housed in the respective said housings of stationary centre and removable counter-centre;
- an idle shaping pulley in the form of a cylindrical roller, which is provided with centre holes opposite to each other for said fixed centre and said removable counter-centre, respectively on the bases of the shaping pulley.

It should be appreciated that the pulley assembly according to the present invention permits a shaping pulley of a notching machine to be located in an easy and quick way.

Advantageously, the pulley assembly according to the invention has the typical feature of a system with opposite live centres, i.e. the self-centring feature. Further, the system with opposite live centres, as it permits, differently from the prior art, the support of the shaping pulley on a double pair of rolling bearings, allows for smaller shafts to be used with respect to the prior art. As a positive consequence, the arrangement with pairs of rolling bearings allows higher speeds with less vibrations and more durability with respect to the prior art.

Further, the number of components of the support of the shaping pulley is reduced because each pulley, independently of its diameter, can be mounted on the same opposite live centres provided that all the pulleys have the same centre hole.

Yet, as the pulley is made in the form of a preferably solid roller, all the shaping pulley assembly has a great rigidity.

BRIEF DESCRIPTION OF THE DRAWINGS

The invention will be described below with reference to embodiments thereof with connection to the enclosed drawing, in which.

DETAILED DESCRIPTION OF THE SEVERAL EMBODIMENTS

Figure 1:
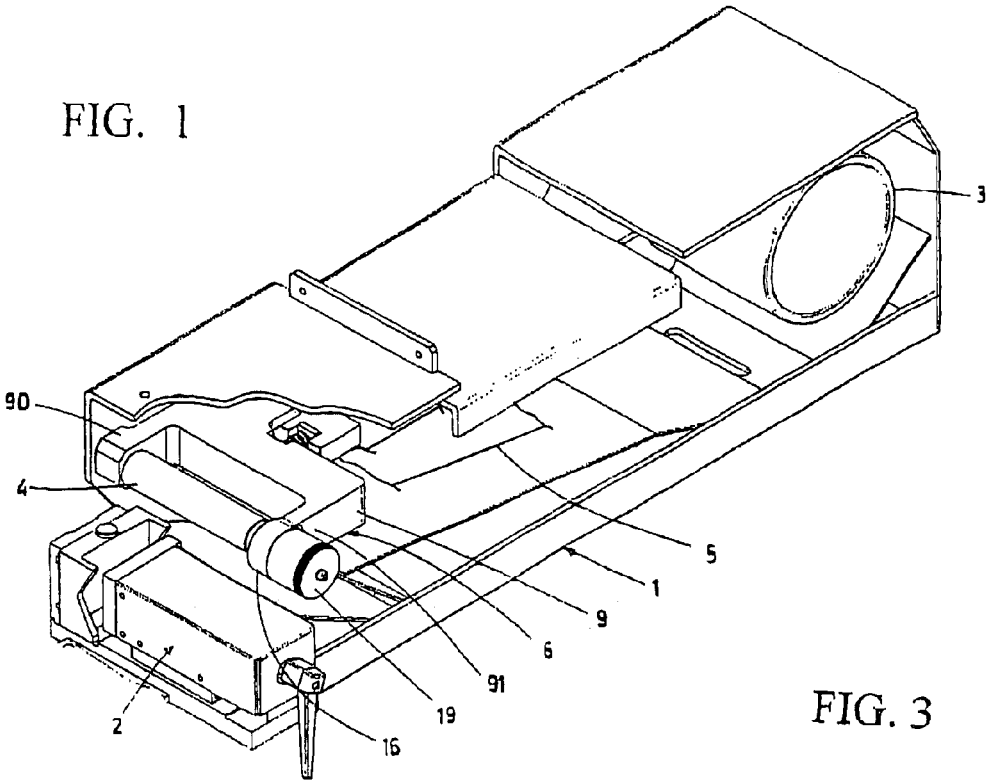
FIG. 1 is a fragmentary perspective view of a notching machine using a shaping pulley assembly according to the present invention.

First with reference to FIG. 1, a notching machine provided with a shaping pulley assembly according to the present invention is shown therein in a fragmentary perspective view. In FIG. 1 a frame is designed in general as 1, and a vice for a tubular workpiece, that is shown without its support base on frame 1, is designed as 2.

A pair of pulleys 3, 4 carry a grinding belt 5. The pulley 3 is a driving pulley for the grinding belt 5, and the pulley 4 is a shaping pulley co-operating with the grinding belt 5 to make recesses conventionally in a not shown tubular workpiece (not shown).

The shaping pulley 4 is interchangeable with other pulleys of different diameter (not shown) so to permit that differently sized recesses can be performed.

Figure 3:
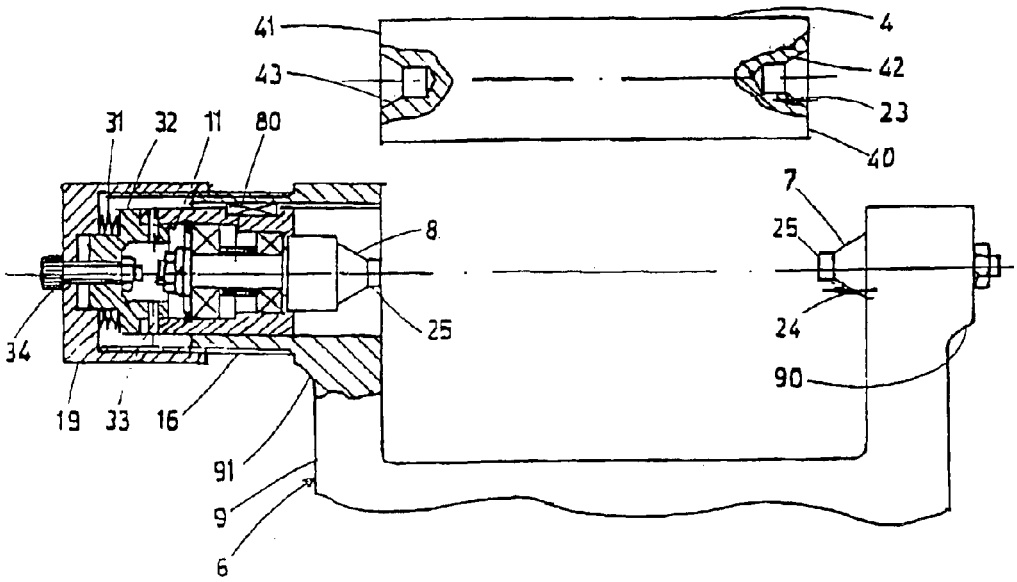
FIG. 3 is a top view, similar to that of FIG. 2, with the shaping pulley being removed from the assembly thereof.

According to the invention, as best shown in FIGS. 2 to 5, which are fragmentary plan views of the shaping pulley assembly, the shaping pulley 4 is a part of a shaping pulley assembly generally designed as 6. The shaping pulley 4 is in the form of a preferably solid, cylindrical roller, having bases 40, 41 in which opposite centre holes 42, 43 are formed (as shown in FIG. 3). The centre holes, like the centre holes that are performed on heads of workpieces designed to be supported in the working operations on machine tools, can be of a standard type. In the embodiment shown the centre holes have a frustoconical section with a taper of 60 degrees internally ending with a cylindrical section being of a diameter equal to the diameter of the minor base of the frustoconical section.

Inserted in the centre holes 42 and 43 are a centre and a counter-centre, which in all the figures, also if modified, are denoted generally in 7, and 8 respectively. The centre 7 and the counter-centre 8 are live centres and are supported in the shaping pulley assembly 6 by a pulley holder element 9 like a fork. The pulley holder element 9, which is supported by the frame 1 in a conventional way, has a C-shaped body with end brackets 90, 91. Each of the brackets 90, 91 is provided with a housing for rolling bearings that are selected to withstand both radial and axial loads to which the centres each to other opposite are subjected. The two housings on the brackets 90, 91 are mutually axial. In particular, provided on the bracket 90, on the centre side, is a race 10 where the centre 7 is stationary mounted, and on the bracket 91, on the counter-centre side, a seat 11 is inserted in which the counter-centre 8 is removably mounted.

As shown in FIGS. 2 to 5, between the shaping pulley 4 and at least one of the centre 7 and the counter-centre 8 there are provided retaining means that causes centre and counter-centre to rotate when the shaping pulley 4 is going to rotate in virtue of the grinding belt 5 which is driven by the driving pulley 3.

Figure 2:
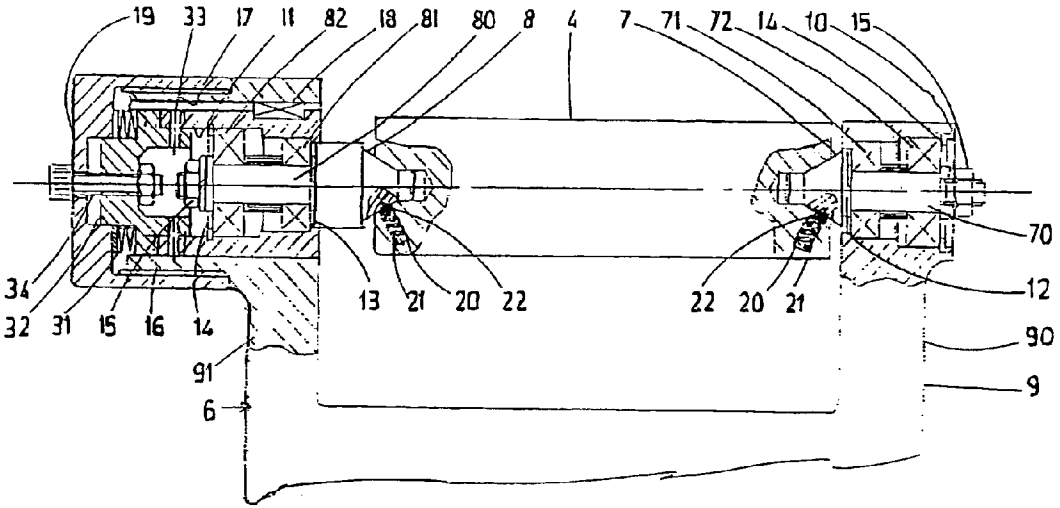
FIG. 2 is an enlarged, partially axially sectioned top view of the shaping pulley assembly in FIG. 1.

With respect to said retaining means, as shown in particular in FIG. 2, holes 20 at right angles to the frustoconical surface of the centre holes 42, 43, as seats of helical springs 21, are formed the pulley 4. The springs 21 charge a ball 22 against a recess which is correspondingly formed on the frustoconical surface of a centre 7 and a counter-centre 8. Referring to FIG. 3, a hole 23 parallel to the axis of the pulley 4 is formed in the hole 42 of the pulley 4 for a pin 24 which is integral with the centre 7 in a corresponding way.

Figure 4:
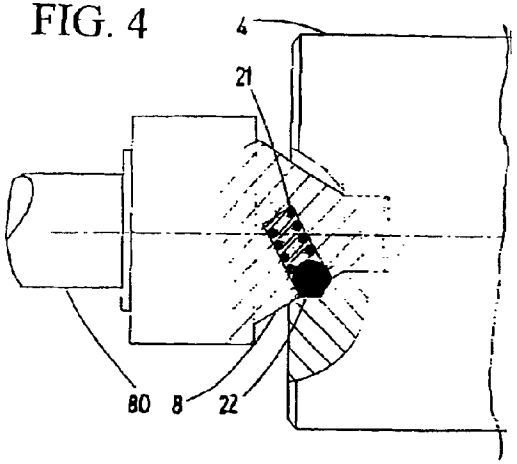
FIG. 4 is a fragmentary top view, similar to that in FIG. 3, which is limited to a first embodiment of a centre retaining means.
Figure 5:
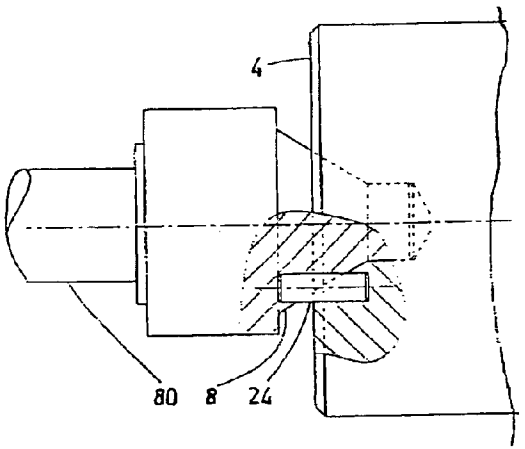
FIG. 5 is a fragmentary top view, similar to that in FIG. 3, which is limited to a second embodiment of a centre retaining means.

The same pin retaining means of FIG. 3 is shown in an opposite location in the counter-centre 8 (FIG. 5), and the retaining means having a spring charged ball, in an inverted position (the seat for helical spring and ball is made in the counter-centre 8, not in the pulley 4) is shown in FIG. 4. It is obvious that the same retaining means can be applied to the centre.

Likewise it is evident that the retaining means can be whether different, but mechanically equivalent, or they could not be necessary if the friction between the contacting surfaces of centre and counter-centre and the surfaces of the respective holes carried out in the idle shaping pulley is enough to let said centre and counter-centre to rotate together with the shaping pulley.

Advantageously to improve their centring, the centre 7 and the counter-centre 8 include in addition to a common frustoconical portion, in their free end a cylindrical portion which is denoted in 25 for the support in respective centre holes. The cylindrical portion 25 could be useful in case a thrust on centre and counter-centre is accidentally reduced, if the frustoconical portion of the same should be no longer in contact with the respective centre holes.

It is evident that the frustoconical centre could be made with less convenience, instead on the supports of the shaping pulley, in the bases of the same shaping pulley in order to engage holes which are correspondingly carried out in the support of the pulley holder element.

Referring again to FIGS. 2 and 3, the stationary centre 7 and the removable counter-centre 8 are explained in details. Both the centre 7 and the counter-centre 8 have a small shaft 70, 80 supported by a pair of radial (71, 81) and axial (72, 82) rolling bearings, which are spaced apart by a spacer. The roller bearings 71, 72 and 81, 82 are retained on the shaft and inside the respective seats of centre 10 and counter-centre 11 by means of an abutting shoulder 12, 13 and an axially fit Seeger type retaining ring 14 and a nut 15.

In order to permit the movable counter-centre to slide, the housing 11 thereof is made in the form of a cylindrical element which is mounted able to slide inside an hollow, cylindrical, externally threaded enlargement 16 which is carried out on the end bracket 91 of the pulley holder element 9 at right angles to the bracket 91. The cylindrical element 11 is prevented to rotate e.g. by a key 18 sliding in its slot 17 which is carried out in the bracket 91. An internally threaded cap 19 is screwed on the hollow cylindrical enlargement 16 in abutment with the free end of the sliding cylindrical element 17 by axially interposing spring charge means, such as Belleville washers 31 abutted between the interior of the cap and an internal counter-cap 32. The spring charge means serves to keep the pulley firmly engaged between centre and counter-centre, notwithstanding the stresses acting on the pulley.

The internal counter-cap 32 is fixed on one side thereof to the cylindrical element 11 by pins 33, and it is connected on the other side thereof in a sliding way to the cap 19 e.g. by a bolt 34.

In such a way when a shaping pulley 4 is mounted on the fork-shaped pulley holder element 9 (FIG. 3) the cap 19 is easily screwed to cylindrical enlargement 16 of its bracket 91, after the shaping pulley 4 is located between centre 7 and counter-centre 8. By screwing the cap, the counter-centre 8, which is connected to the cylindrical element 11 as its housing, moves forward. After the screwing operation, the Belleville washers 31 assure a suitable pressure of the counter-centre 8 in the centre hole 43 of the shaping pulley 4. Vice versa the shaping pulley is removed by screwing the cap 19. In virtue of the internal counter cap 32, even if the cap 19 is screwed completely, the counter-centre 8 does not remain inside the pulley holder element 9 but it is drawn with it. It is evident that, if desired, this can be prevented without the provision of the counter-cap 32, by abutting the Belleville washers between the cap 19 and the cylindrical element 11 of the counter-centre 8.

Further it should be understood that the counter-centre engaging the shaping pulley could be driven by different means, e.g. such as lever means, bayonet means or the like, which for example could increase the replacement speed of the shaping pulley.

What is claimed is:

1. A shaping pulley assembly for a belt notching machine, including on a frame (1) a pair of pulleys (3, 4) carrying a grinding belt (5), the one of the pulleys (3, 4) being a driving pulley (3) for the grinding belt (5), and the other one being a shaping pulley (4) that is interchangeably mounted on the frame (1) to co-operate with the grinding belt (5) for forming differently sized recesses in tubular workpieces and/or solid sections, characterized in that the shaping pulley assembly comprises:

a shaping pulley holder element (9) like a fork supported by the frame (1), having a C-shaped body with end brackets (90, 91), one (90) of which is provided with a housing (10) coaxial to another housing (11) in the other end bracket (91)

a stationary centre (7) and a removable counter-centre (8), both being live centres which are housed in the respective said housings (10, 11) of stationary centre and removable counter-centre;

an idle shaping pulley (4) in the form of a cylindrical roller, which is provided with centre holes (42, 43) opposite to each other for said fixed centre (7) and said removable counter-centre (8), respectively on the bases (40, 41) of the shaping pulley (4).

2. The shaping pulley assembly according to claim 1, characterized in that retaining means is provided among said shaping pulley (4) and at least one of said centre (7) and said counter-centre (8).

3. The shaping pulley assembly according to claim 2, characterized in that said retaining means is constituted by a pin (24).

4. The shaping pulley assembly according to claim 2, characterized in that said retaining means is constituted by a spring charged ball (22).

5. The shaping pulley assembly according to claim 1, characterized in that the live centre and counter centre (7, 8) include a frustoconical portion combined in its free end with a cylindrical portion (25) to be supported in corresponding centre holes (42, 43).

6. The shaping pulley assembly according to claim 1, characterized in that both the centre and counter-centre (7, 8) have a small shaft (70; 80) to be supported by a pair of roller bearings (71, 72; 81, 82) which are retained on the small shaft (70; 80) and inside the respective centre and counter-centre housings (10; 11) by an abutment shoulder (12; 13) and an axially fit, spring retaining ring (14; 14).

7. The shaping pulley assembly according to claim 1, characterized in that said removable counter-centre housing 11 is inserted in the form of a cylindrical element which is sliding mounted without rotation inside an externally threaded, hollow cylindrical enlargement (16) which is made on one (91) of said end brackets of the pulley holder element (9), an internally threaded cap (19) being screwed on said hollow cylindrical enlargement (16) in abutment with said sliding cylindrical element with coaxially interposed spring charge means (31).

8. The shaping pulley assembly according to claim 7, characterized in that said spring charge means (31) are interposed between said cap (19) and an internal counter-cap (32), which is fixed in one side thereof to the said cylindrical element as housing (11) of the counter-centre (8) and connected in a sliding way to said cap (19).

* * * * *